US007093304B2

(12) United States Patent
Griesbach, III

(10) Patent No.: US 7,093,304 B2
(45) Date of Patent: Aug. 22, 2006

(54) SURGICAL GOWN DONNED THROUGH THE SELF-ASSISTED USE OF INFLATABLE CHAMBERS

(75) Inventor: Henry L. Griesbach, III, Clarkston, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 11/005,170

(22) Filed: Dec. 6, 2004

(65) Prior Publication Data

US 2006/0117456 A1 Jun. 8, 2006

(51) Int. Cl.
*A41D 10/00* (2006.01)

(52) U.S. Cl. ..... 2/83; 2/114; 2/69

(58) Field of Classification Search ..... 2/10, 2/DIG. 3, 114, 83, 69
See application file for complete search history.

(56) References Cited

U.S. PATENT DOCUMENTS

| | | | | |
|---|---|---|---|---|
| 2,903,706 | A * | 9/1959 | Alberts et al. | 2/215 |
| 4,041,203 | A | 8/1977 | Brock et al. | |
| 4,674,479 | A * | 6/1987 | Jennings et al. | 600/20 |
| 6,212,716 | B1 * | 4/2001 | Logan et al. | 5/644 |

* cited by examiner

*Primary Examiner*—John J. Calvert
*Assistant Examiner*—Richale L. Haney
(74) *Attorney, Agent, or Firm*—Scott B. Garrison

(57) ABSTRACT

The invention relates to a gown having a gown body, an inflatable chamber capable of selectively inflating and deflating carried by the gown body, and a shaping element carried by the gown body. The shaping element is directly responsive to inflation of the inflatable chamber so that the shaping element is moved from an initial arrangement to a subsequent arrangement by inflation of the chamber. Upon subsequent deflation, the shaping member retains its shape. The entire structure is suitable for the self-assisted donning of a surgical gown.

19 Claims, 3 Drawing Sheets

SURGICAL GOWN DONNED THROUGH THE SELF-ASSISTED USE OF INFLATABLE CHAMBERS

BACKGROUND

The present invention relates to gowns and other garments and particularly to surgical gowns. More particularly, this invention relates to mechanisms that enable a gown wearer to aseptically don the gown on his or her own through the use of selectively inflating and deflating gas filled chambers. Such a gown could be donned by the wearer without requiring him to move his hands outside a region commonly referred to as the "sterile zone". This would serve to minimize the risk of hand contamination prior to a surgical procedure.

As is generally known, sterile surgical gowns are designed to greatly reduce, if not prevent, the transmission through the gown of liquid and biological contaminants that may become entrained therein. In surgical procedure environments, such contamination sources include the gown wearer's perspiration, and patient liquids including blood and life support liquids such as plasma and saline.

Surgical gowns were originally made of cotton or linen and were sterilized prior to the use in the operating room. These gowns, however, permitted transmission or "strike-through" of various liquids encountered in surgical procedures. In these instances, a path was established for transmission of bacteria and other contaminants to and from the wearer of the gown. Furthermore, these gowns were costly and required laundering and sterilization procedures prior to reuse.

Disposable surgical gowns have largely replaced linen surgical gowns. Surgical procedures can require surgical gowns that exhibit total liquid repellency to prevent strike-through, or surgical gowns that are not totally liquid impervious. Whether the surgical procedure dictates the use of a surgical gown that is or is not totally liquid impervious, it is generally preferred that gown closure about the wearer's body occur at the wearer's back and not the wearer's front. In this way, the portion of the gown that overlies the wearer's chest and abdomen may be formed from an uninterrupted sheet of material, albeit that the sheet of material may itself be formed from a plurality of pieces of material stitched or otherwise seamed together.

While a continuous gown front provides improved barrier protection in the areas of the gown most likely to contact or be contacted by liquids when compared to gown fronts which are gapped or interrupted by a closure means, the barrier protection provided by the back of the gown is also a concern for health care providers, gown manufacturers and patients alike. This is because traditional closure means used in disposable surgical gowns, for example, buttons, hooks, tape, and ties, require manual manipulation in order to fasten the side panels together in back of the gown. Moreover, the gown wearer typically requires assistance in closing the back of the gown for at least two reasons. First, the gown wearer often cannot reach the closure means on his or her own due to its location and second, even if he or she could, the wearer's hands would be placed outside the area directly observable by the wearer and into areas considered non-sterile, for example behind the back, below the waist, above the neckline. Hand placement in such non-sterile areas does not conform with accepted practices for maintaining aseptic techniques. Whether the surgical gown is disposable, reusable, liquid impervious, or partially liquid impervious, there exists a need for a back closure gown that enables a wearer, without assistance, to close the back of the gown without moving his or her hands into areas considered non-sterile.

SUMMARY OF THE INVENTION

One aspect of the present invention discloses a gown having a gown body, an inflatable chamber capable of selectively inflating and deflating carried by the gown body, and a shaping element also carried by the gown body. The shaping element is responsive to inflation of the inflatable chamber wherein the shaping element is changed from an initial arrangement to a subsequent arrangement wherein it remains upon inflation and deflation of the inflatable chamber. In some embodiments, the shaping element is folded over upon itself. The folded configuration of the shaping element may be any combination of a c-folded, z-folded, and other collapsible folded configuration. In other embodiments, the gown has a closed front portion and sides terminating in edges that when overlapped form an openable back portion. The deformed shaping element biases the sides away from the front portion which may cause the sides to close upon deflation of the chamber thereby forming the openable back portion. The gown may contain sides that are initially folded over the front portion and inflation of the chamber deforms the shaping element causing the sides to move away from the front portion thereby opening the gown for wearer entry. Other embodiments contemplate that the shaping element curves the sides around a wearer's body after deflation of the chamber. Such shaping elements may be positioned within a sleeve, pocket, or casing within the gown body. In still other embodiments, the shaping element may feature a reversible bend or reversible joint. There may be a corresponding inflatable chamber for each shaping element and in many embodiments the inflatable chamber and its corresponding shaping element are operationally linked. In many embodiments the chamber is inflated by a source of compressed fluid or a manual pump. The gown may allow for deflation of the chamber to a non-sterile zone. The shaping element itself may be a metal strip or a plastic material. In many embodiments the shaping member is malleable.

DESCRIPTION OF THE INVENTION

Figure 1:
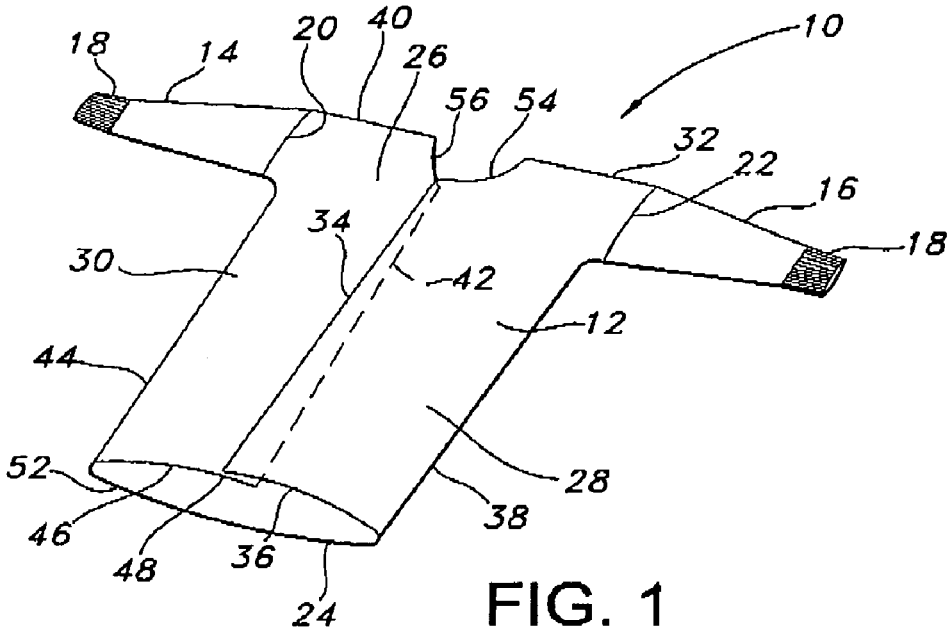
FIG. 1 depicts a gown embodiment of the present invention.

The present invention and its advantages are best understood by referring to the drawings, like numerals being used for like and corresponding parts of the various drawings.

Several terms may be used herein to refer to various parts of the gown as the gown is worn. Thus, "front" refers to that part of the gown which overlays the chest or anterior plane of the wearer; "back" refers to that part of the gown which overlays the back or posterior plane of the wearer, "side" or "sides" refer to that part of the gown which overlays the side or lateral portion(s) of the wearer and which may extend to and overlap the back or front portions of the wearer and are generally located between the front and the back. The term "outer" or "outside" describes that surface of the gown which faces away from the wearer when the gown is being worn; "inner" or "inside" refers to the surface of the gown, or part thereof which faces either the clothes or body of the wearer, while "right" and "left" respectively refer to portions of the gown corresponding to the right and left hand sides of the gown, respectively, as the gown is depicted in FIG. 1.

Additionally, several terms may be used herein to refer to affixing one part of the gown to another part. These terms include "join", "adjoin", "secure", "attach" and derivatives and synonyms thereof. The affixing of these pieces of gown parts to one another may be accomplished by any of several conventional methods. By way of example and not limitation, these methods include stitching, gluing, heat sealing, zipping, snapping, sonic or thermal bonding or using a hook and loop fastening system and other methods familiar to those skilled in the art. Such terms may also refer to closure means where portions of the gown are fastened to each other after the gown is donned by the wearer.

The gown may be formed from a single sheet of material and more particularly a continuous single sheet of material. Alternatively, the gown may be formed from a plurality of such sheets of material adjoined together. In order to provide a greater degree of detail by way of explanation, the gown embodiment described below is one comprising a plurality of sheets joined together. Turning now to the drawings and referring first to FIG. 1 a gown 10 is depicted and arranged in the view so that the viewer is looking at the back 26 of the gown toward the front. The gown 10 includes a body 12 and left and right sleeves 14 and 16, respectively. Both the left and right sleeves, 14 and 16, respectively, may be provided with form fitting cuff sections 18. The left sleeve 14 is secured to the body 12 at a left edge 20 and the right sleeve 16 is secured to the body 12 at a right edge 22.

The body 12 has a closed front section 24 and a pair of opposed side panels, i.e., a right side panel 28 and a left side panel 30 which open and close about the wearer's back. The right side panel 28 may generally be defined by a right upper edge 32, a right side panel edge 34, a bottom edge 36, and a right side edge 38. The left side panel 30 may generally be defined by a left upper edge 40, a left side panel edge 42, a left side edge 44, and a bottom edge 46. As depicted in FIG. 1, the right side panel edge 34 and the left side panel edge 42 may be arranged so that the edges 34 and 42 are non-parallel when the surgical gown 10 is in use. In this configuration, a portion of the left side panel 30 around the left side panel edge 42 and a portion of the right side panel 28 around the right side panel edge 34 may overlie one another when the gown is in use and form an area of overlap 48. It should be understood that the left side panel 30 and the right side panel 28 also need not be equal in size thus placing the edges 34 and 42 closer to one side of the gown or the other.

The front section 24 is defined by the upper edges 32 and 40, a bottom edge 52, the left side edge 44, and the right side edge 38. A neck opening 54, defined by a neck edge 56, may be formed generally between the right upper edge 32 and the left upper edge 40. Other arrangements for neck openings are possible and may include their partial or complete coincidence with the gown's upper right and left edges.

Figure 2:
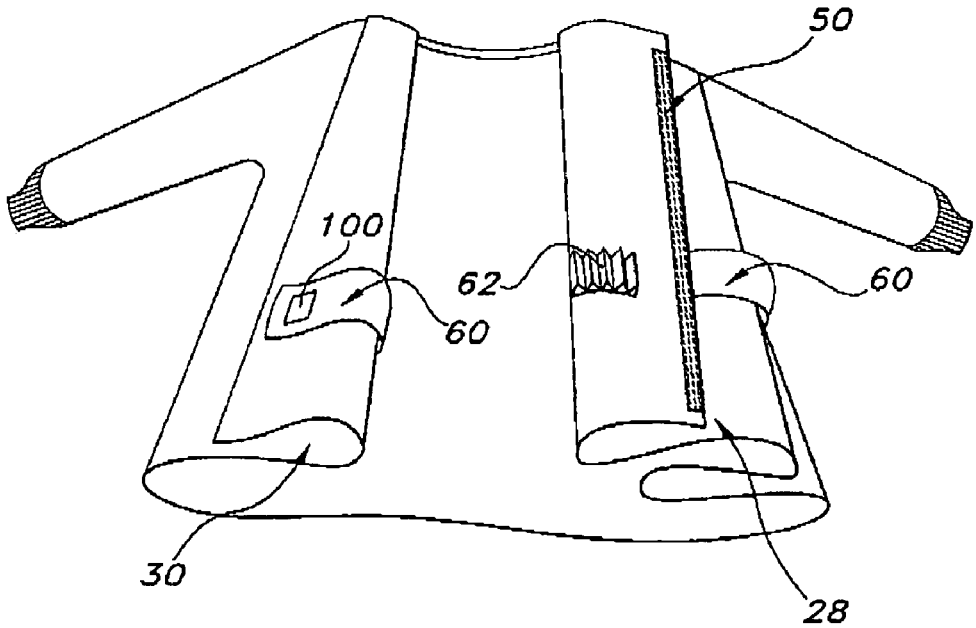
FIG. 2 depicts the FIG. 1 gown, specifically illustrating shaping members and chambers.

The left side panel 30 is secured to the front section 24 along the left side edge 44. The right side panel 28 is secured to the front section 24 along the right side edge 38. As stated, the entire gown may be made of a single piece and therefore the right and left side panels 28 and 30 are simply continuations of the front section 24. In any event, the left side edge 44 extends from the bottom edge 52 and terminates around the base of the left edge 20. The right side edge 38 extends from the bottom edge 52 and terminates around the base of the right edge 22. Notwithstanding the gown construction, i.e., whether it is a continuous sheet or made up of multiple panels joined to one another, a gown closure member 50 such as depicted in FIG. 2 may be utilized to more affirmatively retain the gown in a closed condition after donning. The closure member depicted in this instance comprises a hook and loop type fastening mechanism, but other forms of closure may be used as well, including but not limited to ties, snaps, and adhesive tape and patches.

Looking now in more detail to FIG. 2, a chamber 60 is depicted upon an interior portion of one of the side panels, in this case the left side panel 30. The chamber 60 may be formed of the same material as the base fabric of the panel 30 or may be a disparate material. The chamber 60 is capable of inflating and deflating at the discretion of the wearer. As such, the chamber 60 is constructed of materials, coated with a film or coating, or otherwise provided with the capability to contain a pressurized fluid for a time sufficient to allow the chamber to fill causing the gown 10 to unfold as described below. Additionally, the right side panel 28 depicts a similar chamber 60 on an exterior portion of the side panel. Though this configuration is possible it is primarily meant to illustrate that the chamber or chambers 60 may be placed on either or both the internal or external portions of a side panel.

Looking still to the right side panel 28 as depicted in FIG. 2, a deformable shaping element 62 of one possible configuration is shown. The shaping element 62 works directly in conjunction with the inflation and deflation of the chamber 60. That is, upon inflation of the chamber 60, the element 62 is deformed into a secondary condition differing from its initial configuration. As shown on the right side panel 28, the shaping element 62 may be situated on an interior portion of the gown 10. Likewise, the shaping element 62 may be situated on an exterior face of the chamber 60 itself, or it may be positioned within the chamber 60 itself resulting in it not being externally visible to an end user. In yet an alternative embodiment, the shaping element 62 may be situated proximate to the chamber 60. The important aspect of the shaping element's location is that it be situated sufficiently near its corresponding chamber so that it reacts to the chamber's inflation in a manner described below and as such any reference to its specific location is meant to reflect only one possible embodiment.

Figure 3:
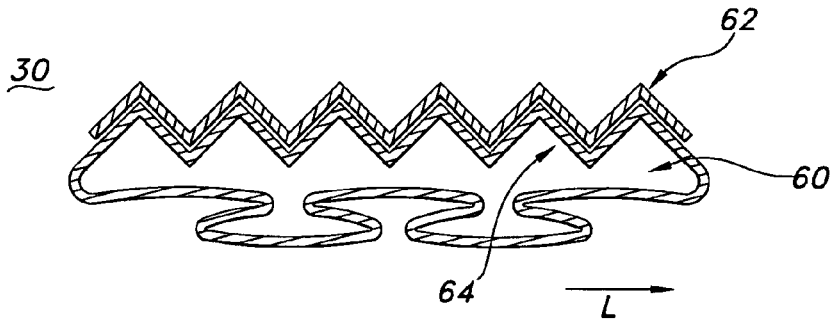
FIG. 3 depicts a cross section of a chamber and shaping member in an initial collapsed condition.
Figure 4:
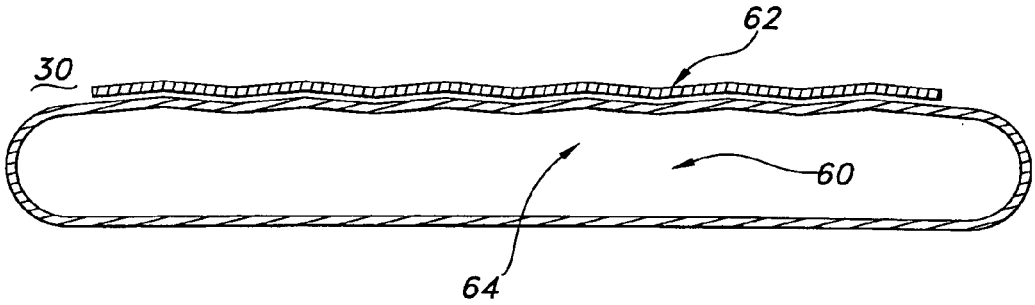
FIG. 4 depicts the FIG. 3 cross section in an expanded condition.

Turning now to FIG. 3, an enlarged view through a cross section of one possible embodiment of chamber 60 and shaping element 62 is depicted. In this view, the shaping element 62 is configured as a collapsed or z-folded batten or stiffener affixed to the chamber 60 itself at a chamber wall 64. As depicted in FIG. 3, the chamber 60 is in an initially collapsed condition since it has not been inflated and the shaping elements are in their initially collapsed configuration. Upon inflation of the chamber 60 as depicted in FIG. 4, it may be seen that the shaping element 62 is expanded or otherwise elongated. This is a result of the fluid pressure introduced and contained for a time within the chamber 60 plastically deforming or otherwise forcing the shaping element into a secondary or non-collapsed state.

To accommodate these capabilities, the shaping element 62 may be made of a malleable material such as a metal or plastic batten. The batten is characterized in that upon having an appropriate stress applied, for example by inflation of the chamber, the batten is stretched, unfolded, interlocked, plastically deformed or otherwise expanded to give a final overall length that is longer than the initial overall length. The term "plastic deformation" means the permanent change in shape or size of a body without fracture, produced by a sustained stress beyond the elastic limit of the material. Plastic deformation is understood to be nonreversible and, as such, subsequent deflation of the chamber 60 will not cause the batten which is used as the shaping element 62 in the gown 10 to revert to its initial state.

Figure 5:
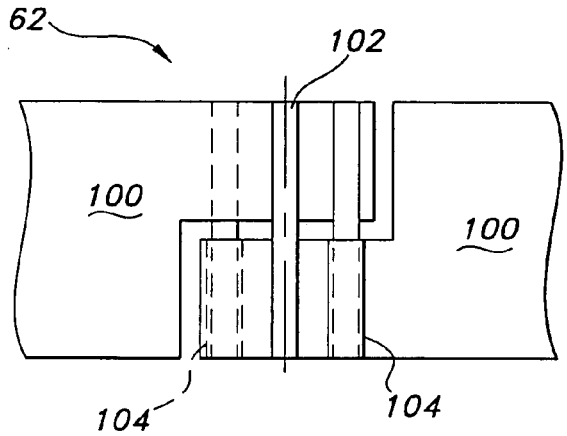
FIG. 5 depicts an alternative shaping member.

Looking now to FIG. 5, another possible configuration for the shaping member 62 is depicted. In this embodiment, the shaping member does not rely upon the property of plastic deformation. Rather it is configured as a series of interconnected and lockable elements. For example, two such elements 100 are depicted as being physically interconnected about a pivot point 102 or hinge of some manner. One or more locking mechanisms 104 are also provided so that once the elements 100 are pivoted a predetermined distance the locking mechanisms 104 engage one another and lock the elements 100 in a rigid or semi-rigid configuration. The structure of the locking mechanism 104 itself may vary considerably from the FIG. 5 depiction. Other mechanisms capable of being manipulated and subsequently locked into a final configuration are known and would be understood by those skilled in the art. As such they are not depicted. Nevertheless, the overall configuration of the shaping elements 62 selected for use in such an embodiment should be provided in a first, unlocked and collapsed condition. Upon inflation of the chamber 60 as previously depicted in FIGS. 3 and 4, the elements 100 would be biased or otherwise caused to pivot about the pivot 102 until such time that they reach a second, locked position characterized in that the locking mechanism 104 snaps or otherwise locks into place. Whereupon deflation of the chamber 60 the locking mechanism 104 would remain in the second, locked position. As would be understood by those skilled in the art, a plurality of such elements 100 would be linked together to form each shaping element 62.

By appropriate selection of material and design of the shaping elements, each shaping element 62 may be made to exhibit an inherent curved profile upon deformation or by engagement of the locking mechanism. This would occur in addition to an effective lengthening of the shaping member. Such a feature may be found useful to cause the gown 10 to curve around a wearer's back after straightening forces on the shaping element are released by deflation of the inflated chambers 60. A gown may be provided with a plurality of such shaping elements 62 that upon activation assist the wearer in donning the gown without assistance.

Figure 6:
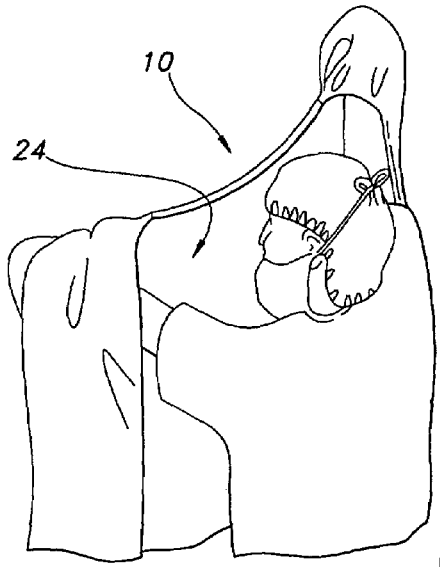
FIGS. 6–9 depicts the donning sequence of the FIG. 1 gown.

In donning such a garment, first the wearer would remove the gown from its sterile packaging, if provided, and allow the gown to unfold as done presently in the industry. The wearer would begin donning the gown 10 as shown in FIG. 6 by placing his or her arms into the sleeves 14 and 16, drawing the front section 24 into contact with his or her chest, again, as would be familiar to anyone skilled in the art. However, unlike prior art gowns, the wearer would next cause the chamber or plurality of chambers 60 to inflate. Inflation of these chambers 60 plastically deforms or moves the shaping element or elements 62 as described supra causing the gown's side panels to extend or otherwise lengthen, thus moving laterally away from the sides of the wearer. Once the shaping elements are properly positioned, that is interlocked or plastically extended, the chambers 60 would next be deflated causing the extended side panels to wrap around the wearer in a desired manner, as discussed infra.

Inflation of the chamber or chambers 60 may be achieved by supplying a gaseous fluid directly or by a conduit connected to the chambers. Supply of the inflating gas may be provided by a container holding a predetermined amount of compressed gas. As one possible example, a cartridge or other container that delivers the requisite amount of gas for proper plastic deformation or extension of the shaping elements to occur may be provided. Other techniques may include the use of a manually actuated bladder such as a squeeze bulb which may be fitted with a one-way valve that transfers air from the ambient environment into the chamber causing the chamber to inflate thereby causing the requisite extension or plastic deformation of the shaping member.

Such containers and/or bladders may be connected externally to the front to the side panels of the gown in areas that allow manipulation while conforming to accepted aseptic practices. Alternatively such containers and bladders may be integrated into the gown's design so that their manipulation for inflating the chambers is done by contacting the external surface of the gown in ways that conform to accepted aseptic practices, for example compressing a bladder against the wearer's body, activating a switch, turning a button, etc. Such manipulation is envisioned as occurring within the front area of the gown below the neckline and above the waist while remaining within the wearer's directly observable filed of vision. These techniques would be known and understood by those skilled in the art.

In any event, deflation of the chambers 60 would subsequently follow the extension or deformation of the shaping members. Means for deflation 100 may include detachment of external connections at the external surface of the gown such that the compressed gas in the chambers 60 are vented, activating switches or turning buttons to open a valve port to vent the compressed gas out of the chambers 60, removing a protective cover over pre-existing vent holes between the exterior surface of the gown and the chambers 60, physical separation of a portion of the externally facing barrier wall of the chambers within a pre-defined boundary (for scored lines defining a perimeter), opening of a zip-lock type seal or closure device as depicted, for example, in FIG. 2, venting to an attached evacuated chamber, etc. Deflation of the inflation chambers 60 vents the gas towards non-sterile parts of the gown, such as the back, through the inside walls of the gown, or to evacuated chambers carried on the gown so that no contamination of the external surfaces of the front and lateral sides of the gown occurs.

Figure 7:
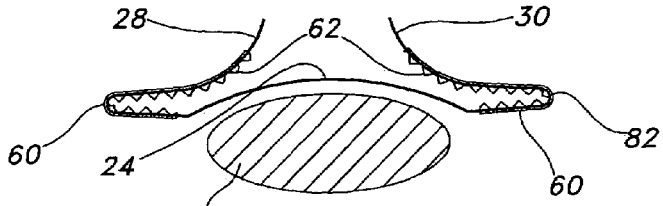
Figure 8:
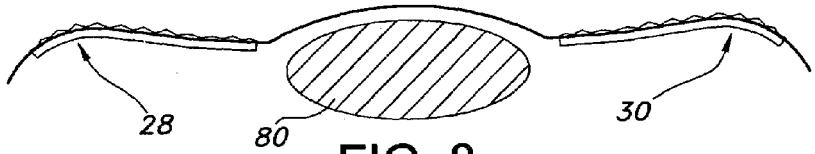
Figure 9:
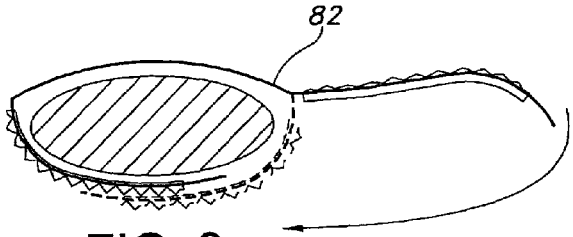

Turning now to FIGS. 7, 8, and 9 the donning sequence of the gown is depicted in a series of cross-sectional views centered on the wearer's torso 80. As seen in FIG. 7, a point subsequent to FIG. 6, i.e., when the front section 24 is in contact with the chest of the wearer, it is noted that right side panel 28 and left side panel 30 may be in a folded orientation across the wearer's torso 80. As such a bend or joint 82 in the shaping element 62 may prove useful as evident in this view. FIG. 8 depicts the chambers 60 inflated at which time the bend or joint 82 is straightened, the shaping elements 62 fully extended, and the side panels 28 and 30, respectively, are extended outward, lateral to the wearer's torso 80. At this point, the shaping elements 62 are in their lengthened or deformed orientation. Once the chambers 60 are deflated as shown in FIG. 9, the shaping elements 62 biases the left and right side panels into their respective positions wrapping around the wearer.

The joint 82, as shown in FIG. 9 may be formed on element 62 in such a way that upon inflation of chamber 60 the joint 80 snaps into its final orientation, as described supra. They to the proper unfolding and folding of this self-donning gown are the behavior of the shaping elements 62 before, during, and after inflation of the chambers. The shaping element or elements 62 must be stiff enough to force fabric areas of the gown into preferred positions, yet be malleable enough to straighten when the chambers 60 are inflated while posing no harm to the wearer.

It is noted that the present invention may be made from a multitude of materials including nonwoven materials suitable for disposable uses. For examples the gown may be made of stretchable nonwoven material so that the gown is less likely to tear during the donning or wearing of the gown. A material well-suited for use with the present invention is a three-layer nonwoven polypropylene material known as SMS. SMS is an acronym for Spunbond, Meltblown, Spunbond, the process by which the three layers are constructed and then laminated together. See for examples U.S. Pat. No. 4,041,203 to Brock et al. One particular advantage is that the SMS material exhibits enhanced fluid barrier characteristics. It should be noted, however, that other nonwovens as well as other materials including wovens, films, foam/film laminates and combinations thereof may be used to construct the gown of the present invention. It is also contemplated that the gown may be coated with a liquid impervious coating to prevent fluid absorption into the gown material.

Although the present invention and its advantages have been described in detail, it should be understood that various changes, substitutions, and alterations can be made therein without departing from the spirit and scope of the invention as defined by the appended claims.

What is claimed is:

1. A gown comprising;

a gown body;

an inflatable chamber capable of selectively inflating and deflating carried by the gown body;

a shaping element carried by the gown body, the shaping element being responsive to inflation of the inflatable chamber wherein the shaping element is moved from an initial arrangement to a subsequent arrangement wherein it remains changed to a deformed arrangement upon deflation of the inflatable chamber.

2. The gown of claim 1 wherein the shaping element is folded over upon itself.

3. The gown of claim 1 wherein the folded configuration of the shaping element is any combination of a c-folded, z-folded, and other collapsible folded configuration.

4. The gown of claim 1 comprising a closed front portion, and sides terminating in edges that when overlapped form an openable back portion wherein the shaping element biases the sides away from the front portion causing the sides to close upon deflation of the chamber thereby forming the openable back portion.

5. The gown of claim 1 wherein the sides are initially folded over the front portion and inflation of the chamber deforms the shaping element causing the sides to move away from the front portion thereby opening the gown for wearer entry.

6. The gown of claim 1 wherein the shaping element curves the sides around a wearer's body after deflation of the chamber.

7. The gown of claim 1 wherein the shaping element is positioned within a sleeve, pocket, or casing within the gown body.

8. The gown of claim 1 wherein the shaping element comprises a reversible bend or reversible joint.

9. The gown of claim 1 wherein there is a corresponding inflatable chamber for each shaping element.

10. The gown of claim 1 wherein the inflatable chamber and its corresponding shaping element are operationally linked.

11. The gown of claim 1 wherein chamber is inflated by a source of compressed fluid.

12. The gown of claim 1 wherein the chamber is inflated by a manual pump.

13. The gown of claim 1 wherein exhaust from deflation of the chamber is vented to a non-sterile zone.

14. The gown of claim 1 wherein the shaping element comprises a metal strip.

15. The gown of claim 1 wherein the shaping element is malleable.

16. The gown of claim 1 wherein the shaping element comprises a plastic material.

17. The gown of claim 1 wherein the shaping element comprises an irreversible bend or irreversible joint.

18. The gown of claim 1 wherein the chamber is vented to an evacuated chamber carried by the gown body.

19. A gown comprising:

a gown body having sleeves, a closed front portion, and sides terminating in edges that when overlapped form an openable back portion;

an inflatable chamber;

a deformable shaping element associated with the inflatable chamber, the shaping element disposed in an initial position corresponding to a first gown orientation, whereupon inflation of the chamber deforms the shaping element thus placing the gown in an intermediate orientation, and subsequent deflation of the chamber places the gown in a final orientation in which the shaping element remains deformed.

* * * * *